United States Patent [19]

Wallace

[11] 4,313,379

[45] Feb. 2, 1982

[54] VOLTAGE-CODED MULTIPLE PAYLOAD CARTRIDGE

[75] Inventor: David W. Wallace, Austin, Tex.

[73] Assignee: Tracor, Inc., Austin, Tex.

[21] Appl. No.: 83,181

[22] Filed: Oct. 18, 1979

Related U.S. Application Data

[63] Continuation of Ser. No. 82,401, Oct. 16, 1979, abandoned.

[51] Int. Cl.[3] ..... F42C 11/00

[52] U.S. Cl. ..... 102/217

[58] Field of Search ..... 102/217, 218, 219, 220, 102/206, 203, 89 CD, 34.5, 37.7; 89/1.5 R; 175/4.55; 361/248, 249

[56] References Cited

U.S. PATENT DOCUMENTS

| | | | |
|---|---|---|---|
| 2,297,006 | 9/1942 | Lohman | 102/217 |
| 2,832,265 | 4/1958 | Reid et al. | 102/217 |
| 2,871,784 | 2/1959 | Blair | 102/203 |
| 3,010,396 | 11/1961 | Coleman | 175/4.55 |
| 3,246,708 | 4/1966 | Harrigan, Jr. et al. | 175/4.55 |
| 3,262,388 | 7/1966 | McCarty | 102/18 |
| 3,451,306 | 6/1969 | Lagerstrom et al. | 89/1.5 R |
| 3,815,271 | 6/1974 | Lynn | 102/217 |
| 4,026,188 | 5/1977 | Woodruff et al. | 89/1.5 R |
| 4,135,455 | 1/1979 | Wallace | 102/217 |

*Primary Examiner*—Charles T. Jordan

*Attorney, Agent, or Firm*—Arnold, White & Durkee

[57] ABSTRACT

A multiple payload cartridge connectible to a source of firing signals by two connecting wires having a first and a second branch each having a squib therein connected in parallel across the connecting wires is characterized by a zener diode connected in series with the second squib in the branch containing the same. The zener diode prevents the flow of current through the branch with the second squib until a firing signal of a predetermined polarity and a magnitude greater than the breakdown voltage of the zener diode is applied across the second branch. The zener diode responds to that firing signal by breaking down into a low resistance conduction path to thereby permit an electrical current sufficient to raise the second squib to incandescence to flow therethrough.

28 Claims, 15 Drawing Figures

TYPICAL IMPLEMENTATION FOR A CARTRIDGE

FIG.6A
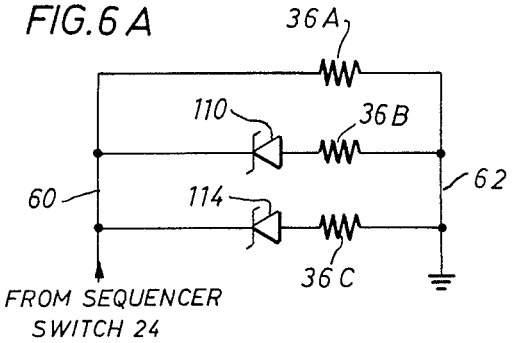
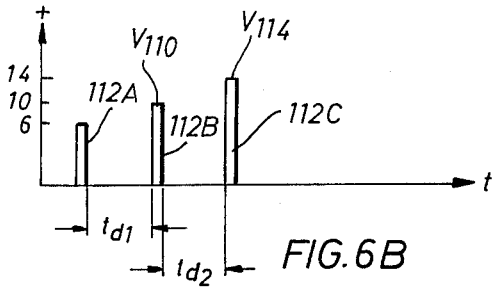
FIG.6B
FIG.7A
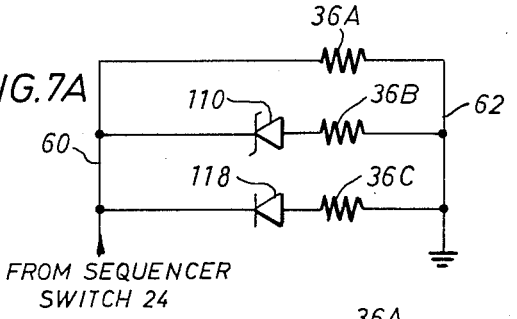
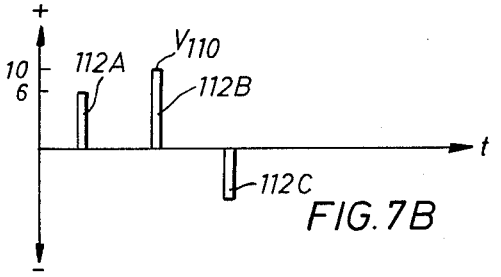
FIG.7B
FIG.8A
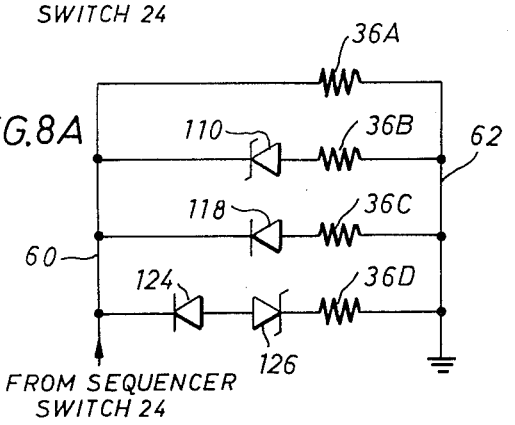
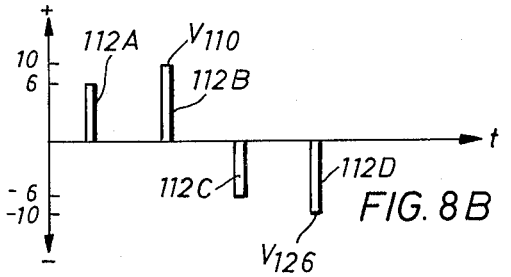
FIG. 8B
FIG.9A
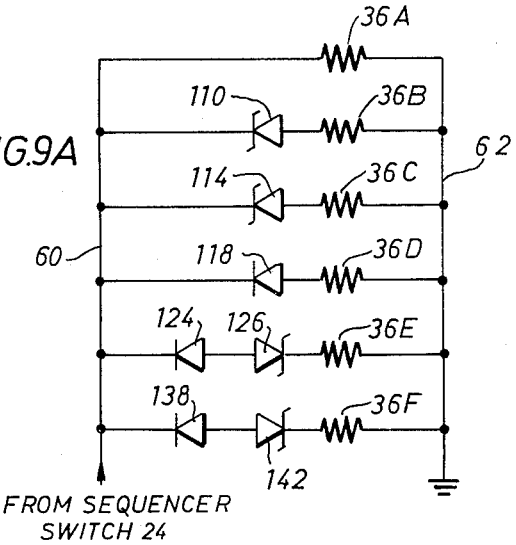
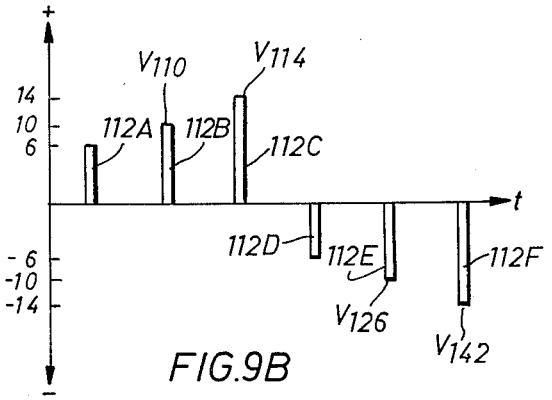
FIG.9B

VOLTAGE-CODED MULTIPLE PAYLOAD CARTRIDGE

CROSS-REFERENCE TO RELATED APPLICATION

This application is a continuation of U.S. patent application Ser. No. 082,401, filed Oct. 16, 1979 and entitled "Voltage-Coded Multiple Payload Cartridge," now abandoned.

BACKGROUND OF THE INVENTION

1. Field of the Invention

This invention relates to electrically initiated expendable payload dispenser systems and, in particular, to an ejector dispenser system having multiple payload cartridges the firing of which is controllable over two connecting wires.

2. Description of the Prior Art

In both military and non-military environments, when it is desired to distribute certain types of ejectable payloads over a wide area, it is common practice to mount the payloads within a dispenser system carried aloft by an aircraft and to eject those payloads over a predetermined area. Typically, in a military context the payload may take the form of military ordinance, smoke generators, photoflash flares, radar detection jammers, propaganda leaflets or the like. Non-military payloads may include fertilizer, seed or advertising materials.

The dispenser system—whether to be used for a civilian or for a military purpose—typically contains a dispenser assembly comprising a dispenser block and an associated control module. The dispenser block is a member which is provided with any predetermined number M of receptacles, or holes, which are designed to receive one expendable payload unit therein. The control module is physically and electrically coupled to the dispenser block and contains the necessary electronic circuitry and connections to control the ejection of the payloads in each payload unit. The dispenser assembly is mounted in any convenient location on the aircraft, with suitable connections being provided between the control module and the aircraft's electrical system. In addition, the control module is electrically connected to firing controls disposed in a location accessable to the pilot of the craft.

A typical chaff dispenser carries thirty expendable payload units or cartridges, although dispensers having fewer and more than this number are also common. Each of such units is typically a square in cross section and about eight inches long although other configurations exist. Each payload unit may be likened to a shotgun shell having an expendable payload which is ejected and having a case or liner which typically remains in the dispenser after the payload is ejected, although some systems operate with an ejectable liner.

The dispensing mechanisms vary, but the most common type includes a pyrotechnic ejection system. Such a system uses an applied electrical signal to heat a bridge wire in a pyrotechnic gas generator referred to as a "squib" or sometimes as an "impulse cartridge". The heated, resistive bridge wire ignites the propellant charge in the ejection squib and the resultant gas pressure ejects the payload from the cartridge or unit. Thus, the system operates much like an electrically initiated shotgun shell.

The squib case holds all of the parts of the dispensing or ejection system and serves as electrical ground connection. The closure disc retains the propellant in the main chamber of the squib until the propellant is ignited, at which time the closure disc is ruptured by the gas pressure generated by the burning propellant. An electrical contact post, insulated from the squib case by a glass or plastic insulator, provides "hot wire" connection to an applied triggering current. The bridge wire is welded to the electrical contact post and to the squib case. Other squib configurations also exist.

When a proper electrical signal is applied between the electrical contact post and the squib case, the bridge wire is heated up and ignites the propellant. The buring propellant generates gas pressure which ruptures the closure disc allowing the gas to pressurize the volume underneath the piston in the payload liner. The piston transmits a pushing force to the payload and, therethrough, to the end cap. The end cap is forced out of the payload liner and then the payload is forced out of the payload liner (i.e., ejected) by the moving piston. The piston is also ejected.

The dispenser carrying the multiple cartridges is electrically connected so that each cartridge receives its signal, in turn, from an electrical contact of a "sequencer" switch, typically a rotary switch or equivalent, which moves from one position to the next.

Solid state switches may also be used in place of the rotary sequencer switch to initiate the desired cartridges.

Existing dispenser systems fall into one of two categories. The first category are those systems wherein a single expendable payload is put into each hole of the system. The second category are those dispenser systems that put multiple expendable payloads into each hole of the dispenser.

For the single expendable payload-per-hole dispenser systems, a common ground is normally employed for the cartridges, which is most often the chassis of the aircraft, or other vehicle. The connections to the sequencer switch include one hot wire running from a separate contact on the sequencer to each hole of the dispenser, thereby providing means for sequentially and separately electrically triggering the squibs. The sequencer, as noted above, functionally operates either as a rotary switch with a movable contact that moves through the individual cartridge connections, or in the solid state sequencer switch, as a firing current source using solid state devices to connect the individual cartridges to the voltage source, providing firing currents, one at a time, to each individual squib. The firing current heats the bridge wire to ignite the ejection charge, which causes ejection of the payload. Thus, one pair of electrical contacts is all that is required for each cartridge in such a system.

In the case of prior art dispenser systems using multiple expendable payloads per hole (cartridge), the wiring is more complex. For simplicity, assume only two payloads in each dispenser hole. In such case, a common ground may be employed; however, two "hot" electrical connections have heretofore been connected to each cartridge, one to the squib operating in conjunction with each payload. Therefore, two hot electrical connections or "firing" pins are required to each dispenser hole to make contact with the ignitors of the dual payloads. Hence, such a system is a three-wire system with three contacts for each hole (two hot connections and one ground connection). Such a system could also use one hot electrical connection and switch the ground between the squibs in the sequencer switch, but three wires would still be required to each hole.

Other variations in the prior art have included as many as four payloads stacked end-to-end or side-by-side in each hole. As can be seen, this has required at least five electrical contacts (four hot contacts and one common ground) for each hole.

As technology has advanced, it has become possible to achieve the desired expendable payload characteristics with smaller expendables. For example, if two expendables could be installed in the place of one, system effectiveness would be vastly increased since more expendables could be carried in the same dispenser volume. In order to minimize modification of existing dispensing systems, it is preferable to avoid physically modifying the dispenser units and aircraft wiring and to instead modify the dispenser electronics (e.g., the sequencer electronics) and/or the expendable unit electronics (i.e., the squib-related electronics) to allow two-wire operation for separately igniting the multiple payloads in a single cartridge.

Therefore, it is a feature of the present invention to provide an improved multiple payload cartridge input connection for separate ignition of the payloads therein using only two wires for connection thereto.

It is another feature of the present invention to provide an improved multiple payload cartridge having means for insuring against the simultaneous ignition of the squibs therein by a single applied electrical pulse, and having means for igniting squibs individually upon command.

SUMMARY OF THE INVENTION

This invention relates to a multiple payload unit cartridge which is provided with a voltage-responsive circuit element, typically in the form of a zener diode, connected in series in the parallel branch with a selected squib. The voltage-responsive circuit element is the type which creates a low resistance conduction path when the absolute magnitude of the voltage of a firing signal applied thereacross exceeds the absolute magnitude of the breakdown voltage. When the applied signal magnitude is less than the breakdown voltage, the circuit element acts as an open circuit. Thus, by disposing a voltage-responsive circuit element having a predetermined breakdown voltage magnitude in series with a selected one of the squibs in the multiple payload unit, it is possible to effectively control the ejection of payloads from the payload unit while at the same time utilizing a narrow range of signal voltage intensities. The invention is applicable to any number of squibs disposed in parallel electrical conduction paths with appropriately controlled signal voltages. The invention may be utilized in pure voltage-magnitude coding systems (all firing signals of the same polarity) or in combined voltage-magnitude and polarity firing systems. In the latter case rectifying diodes (or other polarity-responsive current-inhibiting elements) are utilized in conjunction with the voltage-responsive circuit elements.

BRIEF DESCRIPTION OF THE DRAWINGS

So that the manner in the above-recited features, advantages and objects of the invention, as well as others which will become apparent, are attained and can be understood in detail, a more particular description of the invention briefly summarized above may be had by reference to the embodiments thereof which are illustrated in the appended drawings, which drawings form a part of this specification. It is to be understood, however, that the appended drawings illustrate only typical embodiments of the invention and are therefore not to be considered limiting of its scope, for the invention may admit to other equally effective embodiments.

In the Drawings:

FIG. 5A is a schematic diagram of the electrical system for an array of dual payload units and their manner of interconnection with the circuitry of a solid state sequencer switch in accordance with the instant invention, FIG. 5B shows the electrical detail of the zener diode dual cartridge which can be fired by either the rotary sequencer or the solid state sequencer switch, while FIG. 5C is a signal diagram for the firing signals used to fire the payloads of the dual cartridge of FIG. 5B; and, FIGS. 6A and 6B, 7A and 7B, 8A and 8B, and 9A and 9B are various alternate embodiments of a multiple payload unit in accordance with the instant invention.

DETAILED DESCRIPTION OF THE INVENTION

Figure 1:
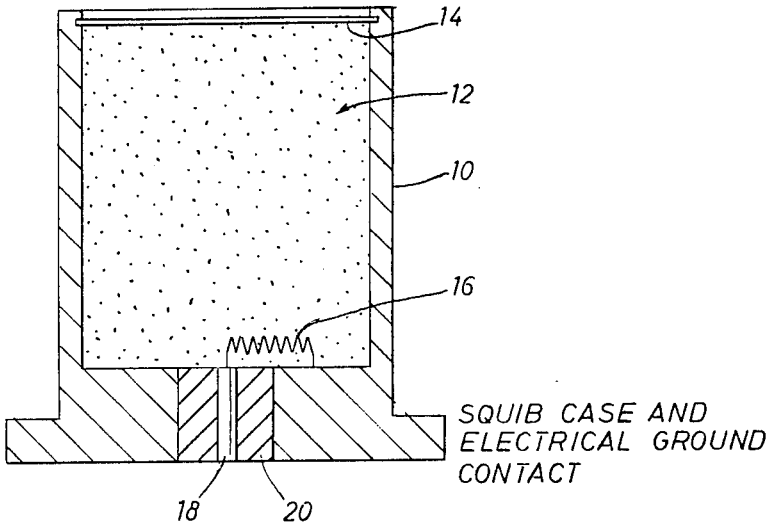
FIG. 1 PRIOR ART
FIG. 1 is a cross sectional view of a typical squib case including electrical ground contact as employed in the prior art.

Throughout the following detailed description similar reference numerals refer to similar elements in all Figures of the drawings.

Now referring to the drawings and first FIG. 1, a squib case, typical in the prior art, is illustrated. The case 10 is generally annular in the configuration and elongated, the main chamber of the squib case being filled with a suitable propellant 12. The end of the case adjoining the payload ejection piston (not shown) is closed by a suitable closure disc 14, the disc readily rupturable upon the ignition of the propellant 12.

The squib case 10 is normally made of a soft, electrically conductable metal. As will be explained more fully hereinafter, the squib case itself normally acts as an electrical ground contact. Some squibs use two electrical leads (one hot and one ground) and a case made from insulating materials, but the disclosures contained herein are still applicable to them.

An electrical bridge wire 16 is connected in the bottom of the propellant chamber of the squib case and is connected between the case and a "hot wire" electrical post 18, which is insulated from the case by an annular insulation 20 surrounding the post. The post 18 may include any suitable resilient or spring-type female contact for receiving a pin for connecting the squib to a suitable electrical circuit for firing.

As described earlier, a dispenser 21 includes a plurality of holes or units for being loaded as cartridges with the main expendable payloads and, if required, main charges. (It should be noted that in most applications a main charge is not necessary, since the propellant contained within the squib is sufficient to discharge the payload from the cartridge without need of a further charge.)

Figure 2:
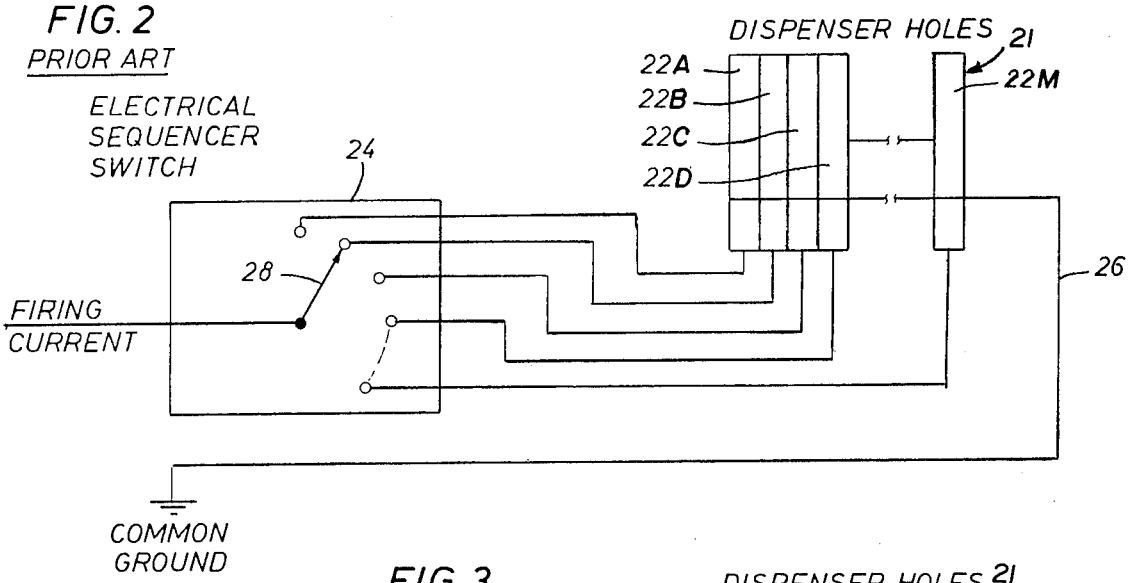
FIG. 2 PRIOR ART
FIG. 2 is an electrical schematic diagram showing electrical connections through a rotary sequencer switch to a plurality of single payload cartridges, as employed in the prior art. This function can also be performed by other means including solid state electronic switching.

In any event, FIG. 2 illustrates a plurality of dispenser holes 22A, 22B, 22C, 22D . . . 22M, each having a suitable squib in the bottom thereof connected by a hot wire to the electrical sequencer switch 24. The dispenser holes are all connected via their squib cases to a common electrical ground 26, although some systems use individuals grounds.

The electrical sequencer switch 24 is typically a rotary switch having a plurality of contacts sequentially and separately actuated by a rotating contact 28, which, in turn is connected to the applied firing current. In operation of the circuit in FIG. 2, an applied firing current, which may be either ac or dc, is applied to the sequencer switch while the rotary arm is swept through the contacts. The applied current to a squib heats each of the respective bridge wires, in turn, to a sufficient degree to ignite the propellant in the related squib. Note that in FIG. 2 there are two wires to each dispenser hole, one a hot wire from the electrical sequencer switch and one a ground wire.

Figure 3:
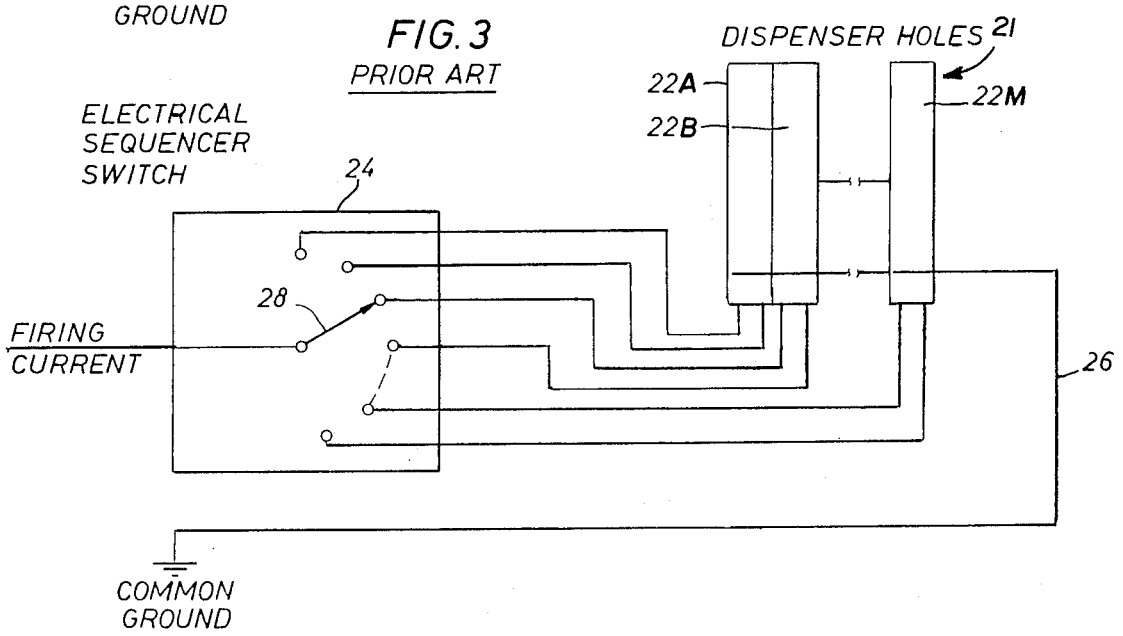
FIG. 3 PRIOR ART
FIG. 3 is an electrical schematic diagram showing electrical connections through a rotary sequencer switch to a plurality of double payload cartridges, as employed in the prior art.

Referring now to FIG. 3, a dispenser 21 is illustrated which is loaded so that each hole therein includes a dual payload. Each payload within a hole has connected therewith its own squib, so that the ignition of the squib associated with the payload nearest the exit end of the dispenser hole is ignitable without igniting the other squib, thereby causing the ejection of only one payload. After the first payload has been ejected, using a second wire from the sequencing switch, the second squib is ignited to eject the second payload from the dispenser hole.

As may be seen, two hot wires are connected between the sequencer switch 24 and each of the dispenser holes, one hot wire being connected to each of the two squibs, respectively. With the same number of dispenser holes as illustrated in FIG. 2, it is possible to double load the dispenser so as to include twice the number of payloads.

Operation of the sequencer for FIG. 3 is essentially identical to the operation of the sequencer switch in FIG. 2 in that when the rotary contact 28 is swept through its positions, one payload at a time is ejected from the dispenser unit.

Figure 4:
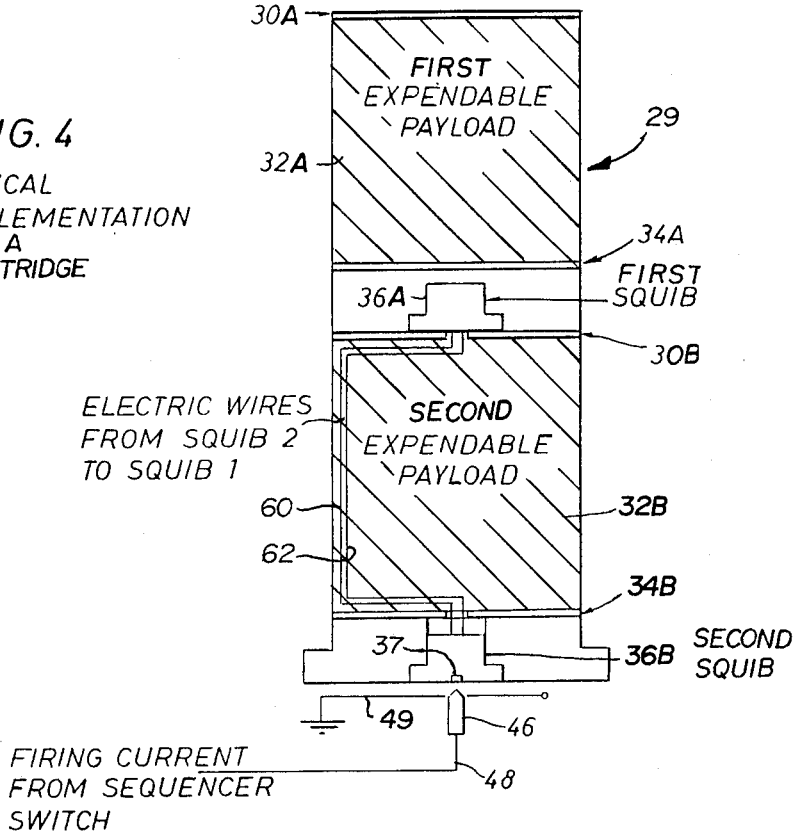
FIG. 4 is a schematic cross sectional view of a double payload cartridge in accordance with the present invention.

Now referring to FIG. 4, a schematic representation of a dual payload unit, or cartridge 29 (used in the loading of a hole 22 in the dispenser 21) is illustrated. Other mechanical configurations may exist with the two expendables placed side-by-side while still retaining the same electrical features, namely, two-wire connection for the separate ejection of two expendables. The discharge end of the cartridge 29 is closed with an end cap 30A to hold a first expendable payload 32A within the cartridge. A piston 34A is housed within the cartridge for activation by a first squib 36A. That is, with the ignition of the propellant of the first squib 36A the disc closure thereof, which is essentially concentric with the opening of the squib, ruptures to cause a gas force against piston 34A. The piston 34A has a much greater area than the end of the squib, essentially the same dimension as the inside of the cartridge housing the payload.

In similar fashion to the first payload 32A, an end cap 30B closes the part of the cartridge 29 housing a second expendable payload 32B. A piston 34B is actuated by a second squib 36B to eject the second payload 32B.

Internal wiring (discussed in connection with FIG. 5) of the cartridge includes two wires from the first squib 36A (on to its center post 37 and one to its casing ground). These electrical connections pass through the end cap 30B in a very small hole therein, preferably in the vicinity of the center. The electrical connections to the first squib 36A are made from the squib 36B through a tiny central hold in the piston 34B. The specific connections are described more fully hereinafter with respect to the various schematic diagrams illustrated below.

Ground contact is made to the casing of the squib 36B by a suitable means such as a spring type contact or a direct connection. A spring loaded electrical contact pin 46 is typically employed to connect with the electrical post 37 of the squib 36B, this pin being connected to a hot wire 48 leading to the sequencer switch. The connection through the sequencer switch to a suitable power source is in the same manner as described above with respect to the prior art systems. The difference is that the source produces sequential firing for more than one payload before the sequencer switch is stepped to a subsequent position. Note that only two electrical connections are made to the cartridge 29, one being a common ground connection 49 and one being a single hot wire connection 48, even though the cartridge 29 is loaded with a dual payload.

Figures 5A, 5B, 5C:
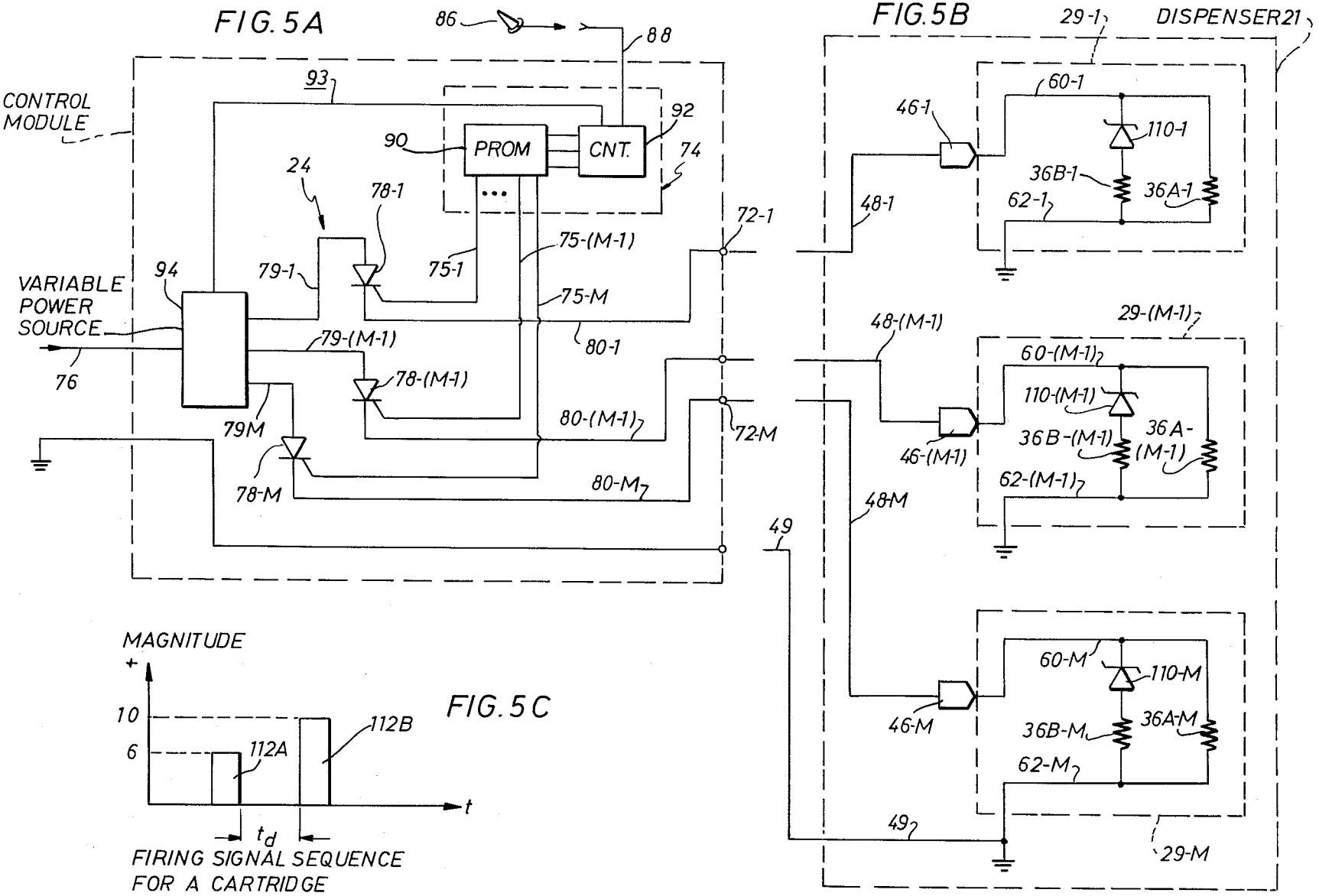

As seen in FIG. 5B, each of the squibs 36 disposed within each payload unit or cartridge 29 is electrically connected in a parallel branch between electrical leads 60 and 62. Physically, the lead 60 is connected to the source of firing signals through the spring loaded contact pin 46. Line terminals 72 (connected over the lines 48 to the contact pins 46 in each payload unit 29) are connected to switches 78 disposed in a control module connectable to the dispenser (FIG. 5A). A logic 74 controls the application of firing signals to the selected one of the M payload units or cartridges 29. Once a given payload unit 29 is connected to the source of firing signals, the explosion of the each of N expendable payloads in that cartridge is facilitated by the firing of each squib 36. The sequence in which the squibs are raised to incandesence is controlled by the characteristics of the electrical components connected in the parallel branch with the squib.

The electrical firing signals applied to the cartridges 29 are derived from the onboard aircraft electrical system. In the usual case, regulated d.c. voltages in a predetermined range are available for application to the control module and, accordingly, to the individual squibs in each payload unit. However, it is believed advantageous to utilize as narrow a range of the available voltage spectrum as possible in order to insure reliable firing of each squib in each unit in the event that the full specified voltage range is rendered unavailable and to fire a maximum number of parallel units.

With reference now to FIG. 5A, shown is a schematic diagram of the electrical circuitry for a control module having a solid state sequencer switch utilized in connection with a dispenser assembly 21 in accordance with the instant invention.

As noted earlier suitable electrical connections are carried over the line 76 from the onboard power system to the control module. Energy for the onboard power system is derived from suitable power sources disposed within the operating systems of the aircraft.

Within the control module an array of switches, as silicon controlled rectifiers (SCR) 78-1 through 78-M, are connected at their anodes by an array of lines 79 to the lines 76 from the onboard power system. Of course, any other switching devices, as solid state transistors, may be utilized in place of the SCR's 78. The cathode of each of the SCR's 78 is connected by an array of lines 80 to terminals 72. The terminals 72 are connected by the lines 48 to the spring loaded connectors 46 at each of the cartridges 29. The control signals for energizing the appropriate one of the SCR's 78 are provided by the logic network 74. Output lines 75 from the logic network 74 are connected to the gate terminals of each of the SCR's 78. When it is desired to initiate operation and eject the multiple payloads carried within each of the cartridges 29, the pilot or other operator or system disposed within the aircraft may energize a suitable remote control element 86 which in turn initiates the operation of the logic network 74 over a control lead 88. Although any suitable logic network may be utilized, a possible configuration therefor may include a programmable read-only memory (PROM) 90 which is sequenced through each of the plurality of memory locations disposed therein by an address counter 92. The counter 92 is also connected over an array of lines 93 to a controllable variable voltage power source (CVVP) 94, which is in turn connected to the line 76 from the on board aircraft power system. The output terminals of the PROM 90 are connected to an appropriate ones of the lines 75. As the counter 92 steps through the plurality of memory locations disposed within the PROM 90 an enabling output signal appears on one of the selected lines 75 which enables the gate of the silicon controlled rectifier 78 associated therewith. This in turn completes the electrical connection between the controllable variable voltage power source 94 and the selected cartridge 29. The CVVP converts the input power from the aircraft into the required voltage to fire the appropriate squib 36 within the desired cartridge 29 under control of the counter.

Other suitable configurations for the logic network 74 include a programmed microprocessor arrangement adapted to selectively connect one or more of the M cartridges 29 with the CVVP 94. Other equally effective alternatives exist.

As seen in FIG. 5B, each of the cartridges 29 contains a firing squib 36 adapted to cause the expulsion of the propellant charge associated with that squib. If there are N ejectable payloads contained within any given cartridge 29, there are necessarily N propellant charges and N squib wires 36 all connected in parallel also associated therewith. As seen in FIG. 5B, the cartridges 29 are assumed to be dual payloads (N=2), in which case there are only two squibs 36A and 36B, disposed within each cartridge 29.

Each of the squibs 36A and 36B (which may be schematically represented by one-ohm resistance) is connected in a parallel electrical branch between the hot wire 60 and the chassis ground lead 62. All chassis ground wires may be connected in parallel to the chassis ground 49. The squibs 36A are raised to incandescence when an electrical current of sufficient amperage is conducted therethrough. The current elevates the proper squib 36A or 36B as desired to incandescence and therefore causes the propellant charge associated with that squib to explode expelling the proper expendable payload from the case 10.

In order to prevent the simultaneous firing of both of the squibs 36 it is in accordance with this invention to provide a voltage-responsive circuit element 110 electrically connected in series in the parallel branch containing the second squib 36B. The voltage-responsive circuit element 110 is selected to be of that type which breaks down into a low-resistance conduction path when a voltage of a predetermined magnitude and predetermined polarity is applied thereacross. Especially useful as the voltage-responsive circuit element 110 is a zener diode having a predetermined breakdown voltage magnitude associated therewith. That is, when the zener diode 110 is reverse-biased and a voltage magnitude in excess of the magnitude of the breakdown voltage is applied thereacross, the zener diode 110 breaks down into an essentially low resistance conduction path. Any reverse bias voltage less than the magnitude of the break-down voltage will permit no current flow through the branch having the zener therein. As used herein, by the term "breakdown voltage" it is meant that voltage magnitude, which when applied across the zener diode such that the cathode of the zener diode is at a more positive potential with respect to the anode, produces a relatively large current flow for a relatively small voltage increment. The term "zener voltage" may also be used as a synonym for the term "breakdown voltage" as that latter term is used herein.

In operation, once a given cartridge 29 has been connected to the CVVP, a series of firing signals (shown in FIG. 5C) is applied to the enabled cartridge 29. If it is assumed that the breakdown voltage v.b.d. for the zener diode 110 is eight v.d.c., and if it is further assumed that a firing current of five amperes is needed to raise the squibs to incandesence, it may be readily appreciated that the first firing signal 112A, having a voltage magnitude of positive six volts d.c. generates sufficient current through the squib 36A to raise it to incandesence.

However, the signal 112A has a voltage magnitude less that the magnitude of the zener diode breakdown voltage. Accordingly, no current flow through the branch having the second squib 36B is permitted due to the presence of the zener diode 110 in that branch. The occurrence of the second firing signal 112B, assumed to be positive ten volts d.c., does cause the breakdown of the zener diode 110 into the low resistance conduction path. Application of the signal 112B across the second parallel branch effectively causes the zener diode 110 to short circuit for a period of time (approximately five to one hundred fifty milliseconds) necessary to permit the squib 36B to be raised to incandesence. The timing $t_d$ between the signals 112A and 112B may be adjustably selected, but may typically be anywhere in the time range between fifteen milliseconds and many days.

From the foregoing, it may be appreciated that due to the presence of the series-connected zener diode in the second branch, current flow in that branch is prevented until a firing signal of a voltage magnitude equal to or greater than the zener breakdown voltage is impressed across that branch. The presence of the zener diode 110 effectively voltage codes the firing of the squibs 36A and 36B since the polarity of the firing signals 112 is the same, the signals differing only in voltage magnitude. The use of the zener diode 110 is believed advantageous, however, since a small range of operation voltages is needed to fire the squibs 36A and 36B. In operation the voltage range for the firing signals 112 must encompass a voltage signal that is less than the magnitude of the zener diode breakdown voltage and a voltage signal that exceeds the magnitude of the zener diode breakdown voltage. A typical voltage range between the firing signals 112A and 112B is four volts, although any other predetermined voltage spread may be used.

The zener diode 110 may be that sold by any supplier, having a predetermined breakdown voltage and having the ability to carry five amperes of current, although other current levels may be designed into the squib bridge wire. In practice, a zener diode manufactured by either Motorola or Texas Instruments and sold under the IN4700 and IN4600 Series is acceptable. The precise model number of the zener diode will depend, of course, upon the particular zener voltage desired. Likewise all zener diode used in the following alternate embodiments are to be construed as preferably similar to those discussed, although it is emphasized that suitable diodes are manufactured by many other manufacturers in the United States and other countries.

The current-inhibiting effect of the zener diode 110 during the occurrence of the firing signal 112A is also believed advantageous. Since the magnitude of the signal 112A is below the zener breakdown voltage magnitude, essentially zero current flows through the second branch during the application of the first firing signal 112A. This "safety margin" is believed desireable to prevent firing of the second squib 36B until the second firing signal 112B is applied.

Referring to FIGS. 6A and 6B, another configuration of squibs 36 and voltage-coded firing arrangement therefor is shown. In FIG. 6A, a third squib 36C is disposed in a third parallel branch betweem the lines 60 and 62. A second zener diode 114, similar to the zener diode 110 but having a breakdown voltage magnitude greater than the magnitude of the breakdown voltage for the zener diode 110, is connected in series with the squib 36C. The squibs 36A and 36B fire as discussed in connection with FIGS. 5B and 5C.

In FIGS. 6A and 6B, the third squib 36C is fired by the application of a third firing signal 112C, greater in magnitude than the breakdown voltage of the zener diode 114. (The polarity is the same for all three firing signals 112A, 112B and 112C.) It may be appreciated that due to the presence of the zener diodes 110 and 114, essentially no current flows through the second and third branches during the application of the first firing pulse 112A. Further, due to the presence of the zener diode 114, essentially no current flow occurs in the third branch during the application of the second firing pulse 112B. Only upon the application of the third firing signal 112C, having a voltage magnitude which exceeds the breakdown voltage magnitude of the zener diode 114, is a current permitted to flow through the third squib 36C. The occurrence of the signals 112A, 112B, and 112C need not be equally spaced, but any predetermined time different $td_1$, and $td_2$ may be used. This is true for all of the other embodiments discussed herein.

It is especially to be noted that in the firing arrangements of FIGS. 5 and 6, the ignition of any subsequent squib is not dependent upon the firing of any preceding squibs. That is, each squib 36 is physically and electrically independent of the firing of any preceding squib. This fact is also true for the other embodiments discussed herein.

It is also within the contemplation of this invention to utilize the voltage-responsive circuit element firing arrangement discussed herein in a combined polarity and voltage coding system. With reference to FIGS. 7A and 7B, one such combined polarity and voltage magnitude coding system is illustrated together with the sequence of firing signals therefor.

In FIG. 7A the first squib 36A and the second 36B are each connected in parallel electrical branches between the connecting wires 60 and 62. The zener diode 110 is connected in series with the second squib 36B. The third squib 36C is disposed in third parallel electrical branch and has connected in series therewith a rectifying diode 118. It is noted that the polarity of the zener diode 110 and the rectifying diode 118 is reversed. Any suitable rectifying diode (typically five amp, five watt) may be used as the rectifying diode 118 or as the other rectifying diodes discussed herein.

When the first and second firing signals 112A and 112B are applied, these signals being of the same polarity but different in voltage magnitude, the blocking effect of the rectifying diode 118 prevents the flow of current in the third parallel branch. The voltage-coding afforded by the zener diode 110 in the second parallel branch prevents the flow of current therethrough until a firing signal having a voltage magnitude greater than the breakdown voltage of the zener diode 110 is applied across the second branch. This is identical in operation to the voltage-coded system shown in connection with FIGS. 5 and 6. The third firing signal 112C is of opposite polarity from the first and second firing signals (FIG. 7B), thus rendering the rectifying diode 18 conductive, to ignite the third squib and to fire the propellant.

An extension of the system shown in FIG. 7 is shown in FIG. 8A with the sequence of firing signals illustrated in FIG. 8B. The system of FIG. 8A is but an extension of the combined polarity and voltage-coding system shown in FIG. 7A with the addition of a fourth parallel electrical branch containing a fourth squib 36D. Connected in series with this fourth squib 36D is a second rectifying diode 124 and a second zener diode 126. The polarity of the rectifying diode 124 corresponds to the polarity of the rectifying diode 118. The second zener diode 126 is of opposite polarity to the rectifying diode 124. The sequence of firing voltages is as shown in FIG. 8B. The breakdown voltage magnitude for the second zener diode 126 need not necessarily equal the magnitude of the breakdown voltage for the second zener diode 110.

Thus, when the first and second firing signals 112A and 112B are applied to the network of FIG. 8A the presence of the rectifying diodes 118 and 124 prevent the passage of the electrical current through the third and fourth parallel branches. The voltage-coding effect imparted by the first zener diode 110 permits current flow in the second parallel branch only if the magnitude of the firing signal 112B exceeds the magnitude of the breakdown voltage of the first zener diode.

Thereafter, with the polarity of the firing signals reversed the application of the third firing signal 112C renders the rectifying diodes conductive but due to the voltage-coding effect imparted by the presence of the second zener diode 126 current flow in the fourth branch does not occur. In the case of the third firing signal 112C (FIG. 8B) the magnitude thereof is less than the magnitude of the breakdown voltage of the second zener diode 126. Accordingly a current flow is initiated in the third parallel branch sufficient to fire the squib 36C. Thereafter, the fourth firing signal 112D, exhibiting a magnitude greater than the magnitude of the breakdown voltage of the second zener diode 126, is applied across the fourth parallel branch. A current flow sufficient to ignite the squib 36D is thus permitted therethrough.

FIGS. 9A and 9B illustrate a further extension of the teachings of this invention. The squibs 36A, 36B and 36C are connected as shown in FIG. 6A. Further, squibs 36D, 36E and 36F are connected in parallel branches respectively containing rectifying diodes 118, 124 and 138. The rectifying diodes 124 and 138 are respectively connected in series with a third zener diode 126 and a fourth zener diode 142. The zener diodes are connected in opposite polarity to the rectifying diodes. The magnitude of the breakdown voltage of the fourth zener diode 142 exceeds the magnitude of the breakdown voltage of the third zener diode 126. When the sequence of firing signals shown in FIG. 9B is applied across to the lines 60 and 62, it may be seen that the signals 112A, 112B and 112C will respectively ignite the squibs in the sequence 36A, 36B and 36C. The rectifying diodes 118, 124 and 138 block current flow in the branches in which they are connected. Thereafter, it may be appreciated that the firing signals 112D, 112E and 112F, due to their polarity and magnitude, cause the sequential firing of the squibs 36D, 36E and 36F.

It is specifically to be noted in connection with the timing diagrams of FIGS. 5C, 6B, 7B, 8B, 9B that the occurrence of the firing signals are indicated in bar form. The width of the bars and spacing between them with respect to the time abscissa has no relevance in the above discussions.

The foregoing description of the invention has been directed to particular embodiments in accordance with the requirements of the Patent Act and is set forth for purposes of explanation and illustration. It will be apparent, however, to those having skill in the art that numerous modifications and changes in the disclosed apparatus and circuitry may be made without departing from the scope and spirit of the invention. Modifications necessary to satisfy the needs of any particular field installation, whether increasing or decreasing the number of parallel legs or in scaling the devices or signal magnitudes upward or downward in size or in providing special accessories, are well within the state of the art. These, and any other, modifications of the invention disclosed herein will be apparent to those skilled in the art. It is the intention in the following claims to cover all such equivalent modifications and variations as falling within the scope and spirit of the invention.

I claim:

1. A multiple payload cartridge connectible to a source of firing signals by two connecting wires comprising:

a first and a second squib each respectively connected in a parallel electrical branch between the two connecting wires;

a zener diode having a predetermined breakdown voltage connected in series in the branch containing the second squib, the zener diode preventing the flow of current through the branch with the second squib until a firing signal of a predetermined polarity and a voltage magnitude greater than the predetermined breakdown voltage is applied thereacross.

2. The multiple payload cartridge of claim 1 further comprising:

a third squib connected in a parallel electrical branch between the two connecting wires;

a second zener diode having a second predetermined breakdown voltage connected in series in the branch containing the third squib, the second zener diode preventing the flow of current through the branch with the third squib until a firing signal of the predetermined polarity and a voltage magnitude greater than the second predetermined breakdown voltage is applied thereacross.

3. The multiple payload cartridge of claim 1 further comprising:

a third squib connected in a parallel electrical branch between the two connecting wires;

a rectifying diode connected in series in the branch containing the third squib, the rectifying diode blocking current flow in the branch with the third squib when firing signals of the first polarity are applied thereacross and preventing the flow of current through the branch with the third squib until a firing signal of the opposite polarity is applied thereacross.

4. The multiple payload cartridge of claim 3 further comprising:

a fourth squib connected in a parallel electrical branch between the two connecting wires;

a second rectifying diode and a second zener diode having a second predetermined breakdown voltage connected in series in the branch containing the fourth squib, the second rectifying diode blocking current flow in the branch with the fourth squib when firing signals of the first polarity are applied thereacross, the second zener diode preventing the flow of current through the branch with the fourth squib until a firing signal of the opposite polarity and a voltage magnitude greater than the second predetermined breakdown voltage is applied thereacross.

5. The multiple payload cartridge of claim 4 wherein the magnitude of the second predetermined breakdown voltage is equal to the magnitude of the first predetermined breakdown voltage.

6. The multiple payload cartridge of claim 4 wherein the magnitude of the second predetermined breakdown voltage is greater than the magnitude of the first predetermined breakdown voltage.

7. The multiple payload cartridge of claim 4 wherein the magnitude of the first predetermined breakdown voltage is greater than the magnitude of the second predetermined breakdown voltage.

8. The multiple payload cartridge of claim 2 further comprising:

a fourth squib connected in a parallel electrical branch between the two connecting wires;

a rectifying diode connected in series with the fourth squib, the rectifying diode blocking current flow in the branch with the fourth squib when firing signals of the first polarity are applied thereacross and preventing the flow of current through the branch with the fourth squib until a firing signal of the opposite polarity is applied thereacross.

9. The multiple payload cartridge of claim 8, further comprising:

a fifth squib connected in a parallel electrical branch between the two connecting wires;

a second rectifying diode and a third zener diode having a third predetermined breakdown voltage connected in series in the branch containing the fifth squib, the second rectifying diode blocking current flow in the branch with the fifth squib when firing signals of the first polarity are applied thereacross, the third zener diode preventing the flow of current through the branch with the fifth squib until a firing signal of the opposite polarity and a voltage magnitude greater than the third predetermined breakdown voltage is applied thereacross.

10. The multiple payload cartridge of claim 9 further comprising:

a sixth squib connected in a parallel electrical branch between the two connecting wires;

a third rectifying diode and a fourth zener diode having a fourth predetermined breakdown voltageconnected in series in the branch containing the sixth squib, the third rectifying diode blocking current flow in the branch with the sixth squib when firing signals of the first polarity are applied thereacross, the fourth zener diode preventing the flow of current through the branch with the sixth squib until a firing signal of the opposite polarity and a voltage magnitude greater than the fourth predetermined breakdown voltage is applied thereacross.

11. The multiple payload cartridge of claim 10 wherein the magnitude of the fourth predetermined breakdown voltage is equal to the magnitude of the second predetermined breakdown voltage.

12. The multiple payload cartridge of claims 9 or 10 or 11 wherein the magnitude the fist predetermined breakdown voltage is equal to the magnitude of the third predetermined breakdown voltage.

13. An expendable payload dispenser system comprising:

a source of firing signals of a predetermined polarity and a first and a second voltage magnitude;

a dispenser block having a first and a second receptacle therein for respectively receiving a first and a second multiple payload cartridge, each cartridge being connectible with the source over a pair of connecting wires, each cartridge comprising:

a first and a second squib respectively connected in a parallel electrical branch between the connecting wires associated with each cartridge;

a zener diode having a breakdown voltage greater than the first voltage but less than the second voltage connected in series with the second squib in the branch containing the same, the zener diode preventing a flow of current in the second branch when the first voltage is applied thereacross to fire the first squib but breaking down into a low resistance conduction path when the second voltage is applied thereacross to fire the second squib; and means for selectively connecting the first and second cartridges to the source.

14. The expendable payload dispenser system of claim 13, wherein one of the connecting wires of each pair to each squib are connected in common.

15. The expendable payload dispenser system of claim 13 wherein each cartridge further comprises:

a third squib connected in a parallel electrical branch between the two connecting wires;

a second zener diode having a second predetermined breakdown voltage connected in series in the branch containing the third squib, the second zener diode preventing the flow of current through the branch with the third squib until a firing signal of the predetermined polarity and a voltage magnitude greater than the second predetermined breakdown voltage is applied thereacross.

16. The expendable payload dispenser system of claim 13 wherein each cartridge further comprises:

a third squib connected in a parallel electrical branch between the two connecting wires;

a rectifying diode connected in series in the branch containing the third squib, the rectifying diode preventing the flow of current through the branch with the third squib until a firing signal of the opposite polarity is applied thereacross.

17. The expendable payload dispenser system of claim 16 wherein each cartridge further comprises:

a fourth squib connected in a parallel electrical branch between the two connecting wires;

a second rectifying diode and a second zener diode having a second predetermined break down voltage connected in series in the branch containing the fourth squib, the second rectifying diode blocking current flow in the branch with the fourth squib when firing signals of the first polarity are applied thereacross, the second zener diode preventing the flow of current through the branch with the fourth squib until a firing signal of the opposite polarity and a voltage magnitude greater than the second predetermined breakdown voltage is applied thereacross.

18. The expendable payload dispenser system of claim 17 wherein the magnitude of the second predetermined breakdown voltage is equal to the magnitude of the first predetermined breakdown voltage.

19. The expendable payload dispenser system of claim 17 wherein the magnitude of the second predetermined breakdown voltage is greater than the magnitude of the first predetermined breakdown voltage.

20. The expendable payload dispenser system of claim 17 wherein the magnitude of the first predetermined breakdown voltage is greater than the magnitude of the second predetermined breakdown voltage.

21. The expendable payload dispenser system of claim 15 wherein each cartridge further comprises:

a fourth squib connected in parallel electrical branch between the two connecting wires;

a rectifying diode connected in series with the fourth squib, the rectifying diode blocking current flow in the branch with the fourth squib when firing signals of the first polarity are applied thereacross and preventing the flow of current through the branch with the fourth squib until a firing signal of the opposite polarity is applied thereacross.

22. The expendable payload dispenser system of claim 21 wherein each expendable cartridge further comprises:

a fifth squib connected in a parallel electrical branch between the two connecting wires;

a second rectifying diode and a third zener diode having a third predetermined breakdown voltage connected in series in the branch containing the fifth squib, the second rectifying diode blocking current flow in the branch with the fifth squib when firin signals of the first polarity are applied thereacross, the third zener diode preventing the flow of current through the branch with the fifth squib until a firing signal of the opposite polarity and a voltage magnitude greater than the third predetermined breakdown voltage is applied thereacross.

23. The expendable payload dispenser system of claim 22 wherein each expendable cartridge further comprises:

a sixth squib connected in a parallel electrical branch between the two connecting wires;

a third rectifying diode and a fourth zener diode having a fourth predetermined breakdown voltage connected in series in the branch containing the sixth squib, the third rectifying diode blocking current flow in the branch with the sixth squib when firing signals of the first polarity are applied thereacross, the fourth zener diode preventing the flow of current through the branch with the sixth squib until a firing signal of the opposite polarity and a voltage magnitude greater than the fourth predetermined breakdown voltage is applied thereacross.

24. The expendable payload dispenser system of claim 23 wherein the magnitude of the fourth predetermined breakdown voltage equal to the magnitude of the second predetermined breakdown voltage.

25. The expendable payload dispenser system of claims 22 or 23 wherein the magnitude of the first predetermined breakdown voltage is equal to the magnitude of the third predetermined breakdown voltage.

26. The expendable payload dispenser system of claim 13, with the dispenser block adapted to accept more than two multiple payload cartridges, with each cartridge containing two or more expendables.

27. A multiple payload cartridge connectable to a source of firing signals by two connecting wires comprising:

a first and a second squib each respectively connected in a parallel electrical branch between the two connecting wires; and a voltage responsive circuit element associated with the second squib, the circuit element electrically isolating the second squib and preventing the flow of current through the branch with the second squib until a firing signal having both a predetermined polarity and a voltage magnitude greater than a predetermined magnitude is applied across the voltage responsive circuit element, the voltage responsive circuit element responding to the predetermined firing signal by defining a low resistance conduction path in the parallel electrical branch containing the second squib so that an electrical current from the connecting wires sufficient to raise the second squib to incandescence may be conducted therethrough.

28. The multiple payload cartridge of claim 26 wherein the voltage responsive circuit element comprises a zener diode connected in series with the second squib.

* * * * *

UNITED STATES PATENT AND TRADEMARK OFFICE

CERTIFICATE OF CORRECTION

PATENT NO. : 4,313,379

DATED : February 2, 1982

INVENTOR(S) : Wallace

It is certified that error appears in the above—identified patent and that said Letters Patent is hereby corrected as shown below:

In Column 1, line 42, after "suitable" insert --electrical--.

In Column 2, line 12, delete "buring" and insert --burning.

In Column 7, line 67, after "explode" insert --thereby--.

In Column 13, line 27, delete "fist" and insert --first--.

In Column 14, line 59, delete "firin" and insert --firing--.

Signed and Sealed this

*Tenth* Day of *August 1982*

[SEAL]

*Attest:*

GERALD J. MOSSINGHOFF

*Attesting Officer*

*Commissioner of Patents and Trademarks*